United States Patent [19]

Tachibana

[11] Patent Number: 4,846,857

[45] Date of Patent: Jul. 11, 1989

[54] ELECTRIC DUST COLLECTOR WITH ELECTRODE SUPPORTER THEREFOR

[75] Inventor: Naoji Tachibana, Kobe, Japan

[73] Assignee: Mitsubishi Jukogyo Kabushiki Kaisha, Tokyo, Japan

[21] Appl. No.: 108,490

[22] Filed: Oct. 14, 1987

[30] Foreign Application Priority Data

Oct. 14, 1986 [JP] Japan ..... 61-243517

[51] Int. Cl.[4] ..... B03C 3/04

[52] U.S. Cl. ..... 55/146

[58] Field of Search ..... 55/135, 146, 148, 140

[56] References Cited

U.S. PATENT DOCUMENTS

| | | | |
|---|---|---|---|
| 1,391,436 | 9/1921 | Welch | 55/148 X |
| 1,806,854 | 5/1931 | Hesson | 55/101 |
| 1,826,428 | 10/1931 | Miller | 55/135 X |
| 1,856,225 | 5/1932 | Ryder | 55/101 |
| 1,957,458 | 5/1934 | Horne et al. | 55/146 X |
| 2,615,530 | 10/1952 | Hodson et al. | 55/135 X |
| 3,033,918 | 5/1962 | Wiemer | 55/148 X |
| 3,673,768 | 7/1972 | Leonard | 55/135 |
| 4,678,484 | 7/1987 | Hartmann et al. | 55/146 |

FOREIGN PATENT DOCUMENTS

| | | | |
|---|---|---|---|
| 315262 | 11/1919 | Fed. Rep. of Germany | 55/146 |
| 348216 | 2/1922 | Fed. Rep. of Germany . | |
| 494319 | 3/1930 | Fed. Rep. of Germany | 55/140 |
| 908632 | 4/1954 | Fed. Rep. of Germany | 55/146 |
| 526110 | 10/1921 | France | 55/146 |
| 946476 | 6/1949 | France | 55/146 |
| 120994 | 12/1918 | United Kingdom | 55/146 |

*Primary Examiner*—Bernard Nozick

*Attorney, Agent, or Firm*—Stanger, Michaelson, Reynolds, Spivak & Tobia

[57] ABSTRACT

In a dust collector, reverse U-shaped or reverse V-shaped supports pass through reverse U-shape or reverse V-shaped passages located above a dust collecting chamber. One end of each support passes below the passages and suspends electrodes in the dust collecting chamber, while the other end of each support terminates in an insulator at blind ends below the peaks of the passages. A heater heats the peak of each passage to break the thermal convection between the dust collecting chamber at one end of the passages and the insulators in the other end of each passage.

8 Claims, 7 Drawing Sheets

ELECTRIC DUST COLLECTOR WITH ELECTRODE SUPPORTER THEREFOR

FIELD OF THE INVENTION AND RELATED ART STATEMENT

The present invention relates to electric dust collectors which electrically remove dust contained in or entrained in high temperature gas such as, for example, coal gas, and particularly to electrode supports in such dust collectors.

A known electric dust collector or an electrostatic precipitator electrically collects dust contained in gas. As shown in FIG. 3, the dust collector generally includes a support structure which suspends a discharge electrode 2 so it is disposed within a casing 1 and electrically insulated from the casing 1. For this purpose the discharge electrode 2 carries a potential different from that of the casing 1. The discharge electrode 2 is supported through a suspending member 4 by insulators 3 fixed to inner side ends of the casing 1.

Since the dust collector electrically removes dust entrained in the gas, the discharge electrode 2 is exposed to the gas which contains dust, and the insulators 3 fixed above the electrode are also brought into contact with the gas flowing along the suspending member 4. Accordingly, dust is deposited on the surface of the insulators 3, and gradually as time elapses during operation the dust attaches itself to the surface of the insulators. If the dust is conductive, current flows through the dust attached to the surface of the insulators 3. Consequently, the Joule heat generated by the current breaks down the insulators 3.

Various proposals have been made to protect the insulators 3 from contamination due to the dust. One solution lengthens the distance L from a collecting chamber 5 to the insulator 3 of the dust collector as shown in FIG. 4, that is, the length of a passage 6 accommodating the suspending member 4. However, this system requires a large space above the apparatus, and the dust can not be cut off completely. Accordingly, the attachment of dust during operation over a long time can not be avoided.

A second proposal utilizes the potential of the suspending member 4 to collect dust as shown in FIG. 5. A number of discharging projections 7 on the suspending member 4 collect dust moving toward the insulators 3 within the passage 6. While this arrangement exhibits more effective dust collection than the first arrangement, the attachment of dust over a long period of operation cannot be prevented completely.

A third method, is shown in FIG. 6. Here, clean air or clean gas 8 is passed around the insulators 3 to form a gas seal, so that the gas seal prevents gas which contains dust from approaching the insulators 3. The method is effective in slowing down the speed of contamination on the surface of the insulators 3 because the gas seal is positive and the structure which sucks the clean air from the outside is effective where the pressure in the dust collecting chamber 5 is negative. However, this method must employ a large quantity of inert gas if the gas used in the dust collector is, for example, inflammable and should not be mixed with air. Thus, use of this method is costly.

A fourth system appears in FIG. 7. Here, the insulators 3 are disposed above the dust collecting chamber 5 and a heater 9 heats the gas around the insulators 3 to reduce the concentration of gas around the insulators 3 and to prevent gas which contains dust and which has a high specific gravity from reaching the circumference of the insulators 3 by convection and diffusion. This method can overcome the aforementioned defects and hence has been the most effective method to this time.

This fourth system utilizes the difference in gas concentration caused by the difference in the gas temperature to prevent the gas from reaching the insulators 3. Accordingly, it is necessary to raise the temperature of the insulators as compared with that of the gas which contains dust and is within the dust collecting chamber 5. However, the insulators are generally formed of an oxide such as silica, alumina or zircon and their insulation resistances drop drastically when their temperatures go beyond a given temperature. This reduces the effect of the insulators. Accordingly, this system is not useful when the temperature of the dust-entraining gas exceeds the temperature at which the insulation resistance of the insulators drops precipitously and the insulators can not be used.

OBJECTS AND SUMMARY OF THE INVENTION

An object of the invention is to improve electric dust collectors.

Another object of the invention is to improve the suspension of discharge electrodes in electric dust collectors.

Yet another object of the invention is to avoid the aforementioned disadvantages.

It is another object of the present invention to provide an electrode supporter of an electric dust collector which can prevent attachment of dust to an insulator effectively without any reduction of an insulation resistance of the insulator even when dust contained in high temperature gas is removed.

In order to achieve these objects, an electrode supporter of an electric dust collector according to the present invention comprises a passage disposed on the way between an opening communicating with a upper portion of a dust collecting chamber and a closed portion in which an insulator supporting a discharging electrode is disposed and having a portion disposed at a higher position than that of the closed portion, and heating means mounted at the portion of the passage disposed at the higher position.

Further, in a preferred aspect according to the present invention, passages between insulators supporting a discharging electrode and a dust collecting chamber are formed into a reverse U-shaped or a reverse V-shape and heating means is disposed in a upper portion of the passage. Two sets or a plurality of sets of the reverse U-shaped or V-shaped passages communicate with each other near the top thereof.

According to the preferred aspect, when the upper portion of the passages formed into the reverse U-shape or reverse V-shape having an opening end communicating with the dust collecting chamber is heated to a high temperature, high temperature gas having low concentration stays at the upper portion. Accordingly, gas containing dust from the dust collecting chamber is blocked by the low concentration gas and does not reach the insulators. Consequently, attachment of dust to the surface of the insulators can be prevented effectively.

On the other hand, since the insulators are disposed in the other ends of the reverse U-shaped or reverse V-shaped passages and the heating means does not heat the other ends of the passages, the temperature around the insulators is low. Low temperature gas existing around the insulators is prevented from moving upward by the presence of the high temperature gas existing in the upper portion and stays around the insulators as it is. Accordingly, the temperature of the insulators can be established to less than a maximum usable temperature of the insulators determined by dielectric strength irrespective of the temperature of gas within the dust collector.

According to another feature of the invention, these objects are attained in whole or in part by extending the electrode supports from the electrodes through a heated passage on the upper portion of the dust collecting chamber and to the insulators, and mounting the insulators below the heated passage in blind ducts communicating with the passage.

DETAILED DESCRIPTION OF PREFERRED EMBODIMENTS

Figure 1:
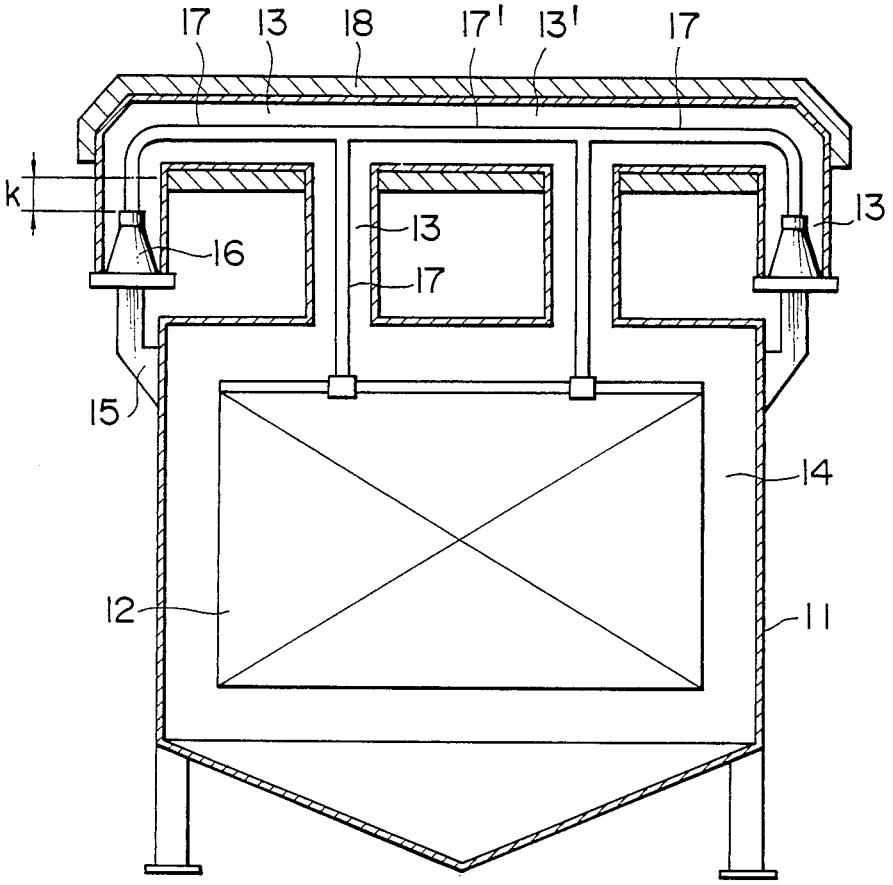
FIG. 1 is a partially cut-away front view of an electric dust collector according to an embodiment of the present invention.

An embodiment of the present invention is shown in FIG. 1, in which numeral 11 denotes a casing which accommodates various parts and through which gas (which contains dust) passes. Disposed within the casing 11 is a discharge electrode 12 which is suspended without contact with the casing 11. The discharge electrode is generally maintained at a negative potential with respect to a ground potential to which the casing 11 is maintained. Two reverse U-shaped passages 13 are coupled with both sides of an upper wall of the casing 11 and communicate with each other near the top thereof through a communicating pipe 13' having a shape substantially similar to that of the passages 13. The passage 13 includes one opening end communicating with a dust collecting chamber 14 of the casing 11 and the other end coupled with a insulator supporting member 15 which is fixedly mounted to an outer surface of a side wall of the casing 11. Insulators are accommodated in the passage 13 and fixedly mounted on the insulator supporting member 15. A heating device 18 is mounted to an outer periphery of the communicating pipe 13' and an uppermost portion of the passages 13.

In the dust collector structure above, the temperature of gas existing in the upper portion of the passages 13 and the communicating pipe 13' is heated by the heating device 18 to more than the temperature of dust-entraining gas introduced into the dust collecting chamber 14. Thus, when high temperature gas which contains dust such as, for example, coal gas is introduced into the casing 11, the gas with dust tends to move into the passages 13 from the dust collecting chamber 14 by convection or diffusion. However, the high temperature gas has a lower concentration than that of the gas which contains dust and exists in the upper portion of the passages 13 and the communicating pipe 13'. Thus the movement of the gas with dust toward the passages 13 is prevented by the existence of the high temperature gas and hence the movement of the gas with dust to the insulators 16 is also prevented.

On the other hand, since the gas around the insulators 16 has a lower temperature than that of the heated gas existing in the upper portion of the passages 13 and the communicating pipe 13', the gas around the insulators 16 can not move upward and accordingly the temperature around the insulators 16 is maintained to the low temperature. Consequently, reduction of the dielectric strength of the insulators 16 due to the increased temperature can be prevented.

Further, a distance k in the vertical direction between the heating device 18 and the insulator 16 is desirably established as follows. The temperature of the heating device 18 is determined to a proper value such that gas, having a lower concentration than that of the gas with dust in the dust collecting chamber 14, forms in the upper portion of the passages 13 and the communicating pipe 13' and prevents the gas with the dust in the dust collecting chamber 14 from flowing into the upper portion by convection. Accordingly, it is necessary to establish the distance k so that the temperature of the insulator 16 does not exceed the permissible temperature in the characteristics of the insulator even if the insulator 16 is heated by the radiation or convection of the gas formed in the upper portion of the passages 13 and the communicating pipe 13'. Determining the distance k in this manner allows use of the insulator 16 below the permissible temperature and can prevent the gas with dust from flowing into the insulator region. In this case, while the temperature around the insulator 16 can be reduced to sufficiently lower temperature than that of the gas containing dust, it is necessary to determine a lower limit of temperature to prevent the water from condensing and attaching to the surface of the insulator due to reduction of the temperature of the gas in the dust collector.

Suspending members 17 in the form of rods having one end connected to the insulator 16 extend through the reverse U-shaped passage 13 to the dust collecting chamber 14 without contact with the passages 13 and support the discharge electrode 12 by the other end thereof extending to the dust collecting chamber 14. A communicating member 17' disposed in the communicating pipe 13' couples the right and left suspending members 17 with each other at the upper end portion of the reverse U-shaped portion in this embodiment.

The communicating member 17' can reduce the bending moment on the suspending members 17 caused by difference of load points (that is, the discharge electrode 12) and supporting points (that is, the insulators 16). Accordingly, the shape of the suspending member 17 can be shortened by use of the communicating member 17' and further the structure of the right and left suspending members 17 can be simplified. Thus, the possibility applying a bending moment to the insulators 16 can be substantially reduced.

Figure 2:
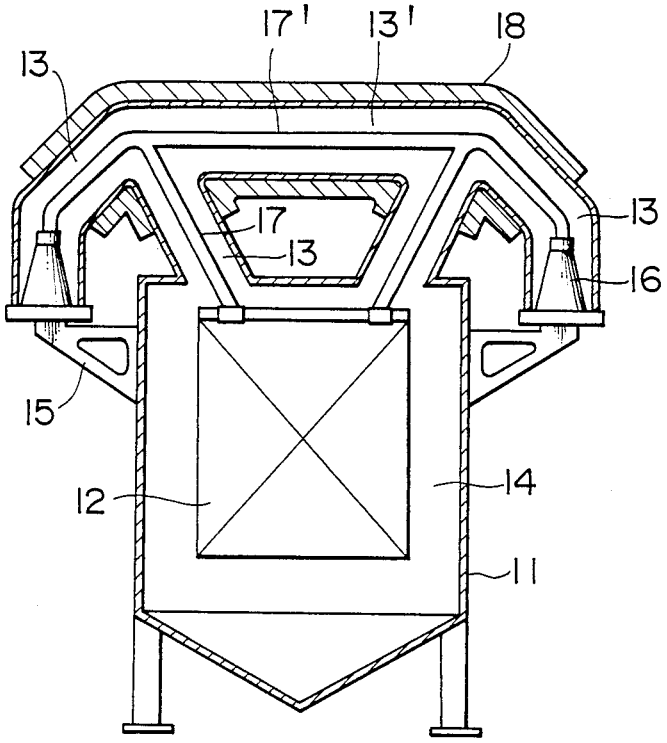
FIG. 2 is a partially cut-away front view of an electric dust collector according to another embodiment of the present invention.
Figure 3:
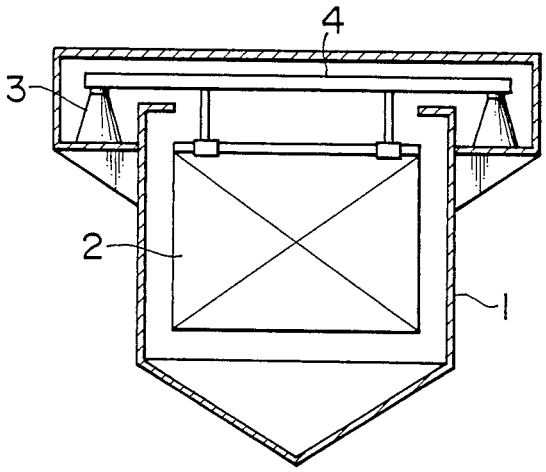
FIG. 3 (PRIOR ART)
FIGS. 3 to 7 are partially cut-away front views each showing a prior art electric dust collector.
Figure 4:
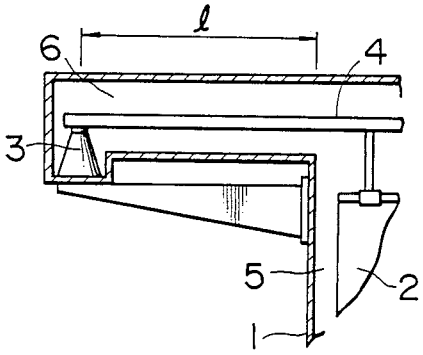
FIG. 4 (PRIOR ART)
Figure 5:
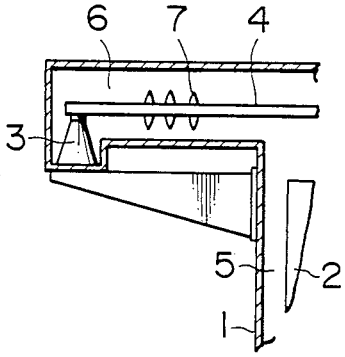
FIG. 5 (PRIOR ART)
Figure 6:
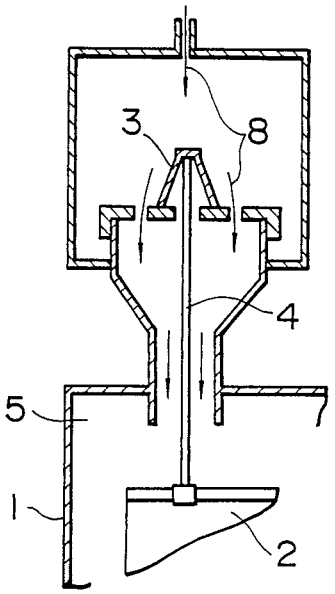
FIG. 6 (PRIOR ART)
Figure 7:
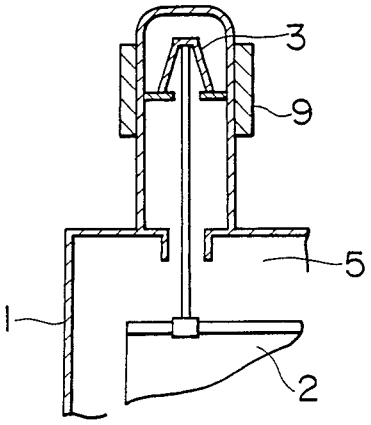
FIG. 7 (PRIOR ART)

The present invention is not limited to the above embodiment, and the passages 13, for example, may be formed into the reverse V-shape as shown in FIG. 2, in which the passages 13 are coupled with each other through the communicating pipe 13' near the top thereof and the suspending members 17 are coupled with each other through the communicating member 17' disposed outside the communicating pipe 13'.

Figure 8:
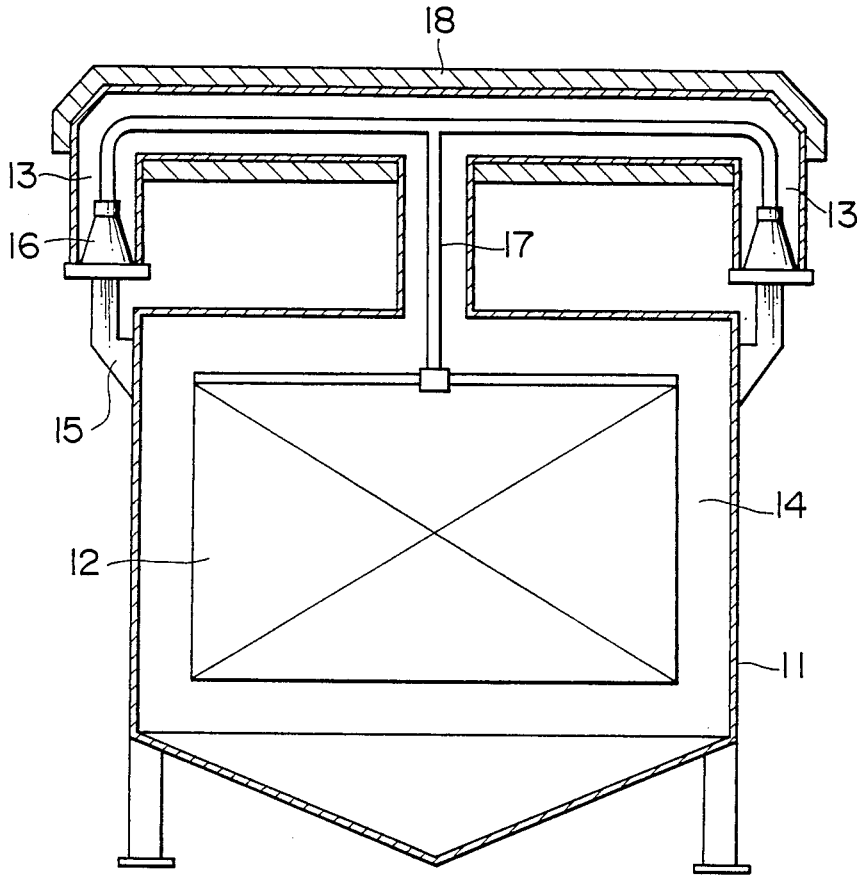
FIG. 8 is a partially cut-away front view of an electric dust collector according to a modification of the present invention.

As an example, as shown in FIG. 8, two sets of passages 13 formed into the reverse U-shape may be combined in parallel and two sets of insulators 16 may suspend part of the discharge electrode 12.

Figure 9:
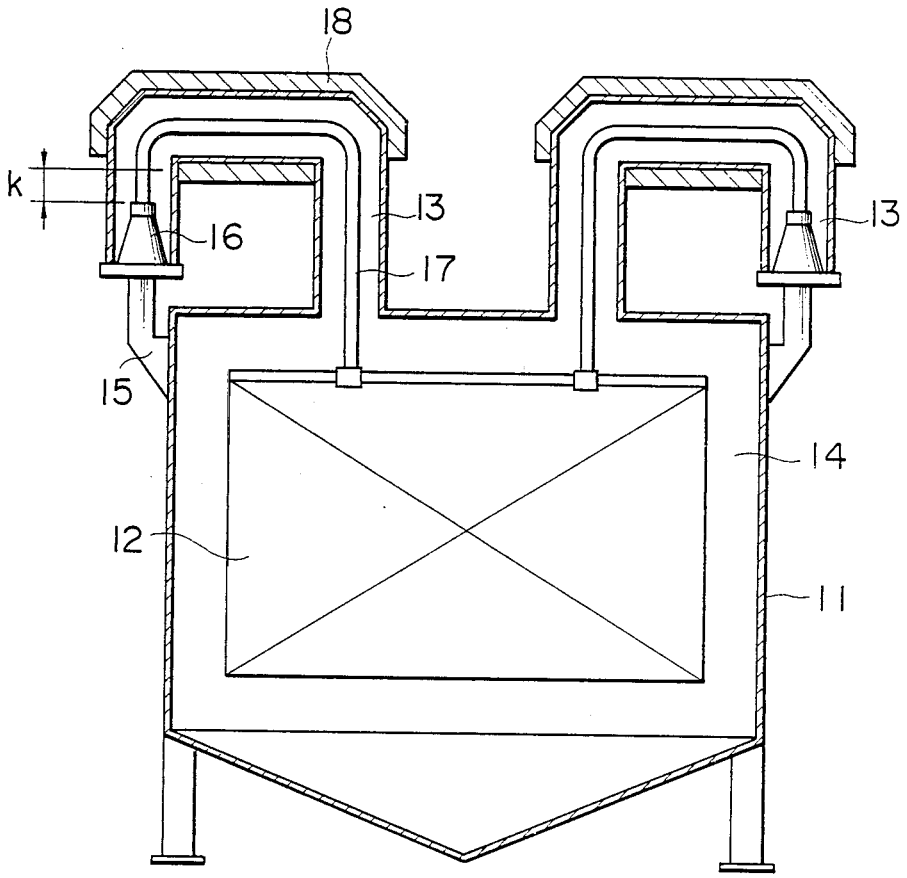
FIG. 9 is a partially cut-away front view of an electric dust collector according to an embodiment of the present invention.
Figure 10:
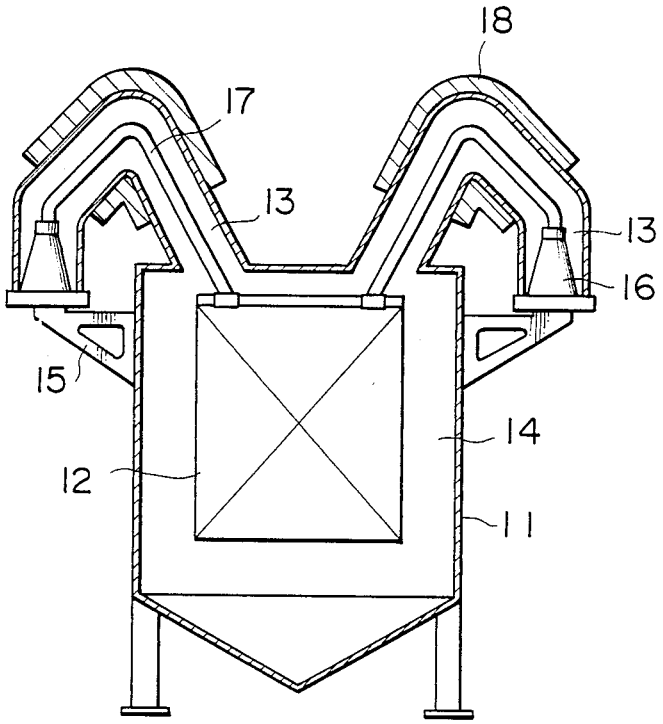
FIG. 10 is a partially cut-away front view of an electric dust collector according to another embodiment of the present invention.

FIGS. 9 and 10 use the same reference characters as the other figures and illustrate embodiments of the invention wherein the suspending members 17 assume inverted-U shapes and inverted-V shapes. The passages 13 follow similar contours.

Further, if the insulators are cooled by, for example, water, the temperature in the upper portion of the passages can be raised so as to collect dust contained in higher temperature gas.

As described above, according to the present invention, even if the temperature of gas in the electric dust collector exceeds the permissible temperature of the insulator, the temperature around the insulator is maintained at a low temperature and the dust contained in the gas can be effectively prevented from flowing into the insulator side. Accordingly, stable operation can be maintained for a long time.

While embodiments of the invention have been described in detail it will be evident to those skilled in the art that the invention can be embodied otherwise without departing from its spirit and scope.

What is claimed is:

1. An electric dust collector, comprising:

a dust collecting chamber having an upper portion;

a discharge electrode in said dust collecting chamber;

a passage having a first and a second end, said passage having an opening at the first end, communicating with the upper portion of said dust collecting chamber and having a closed portion at the second end;

an insulator mounted in said closed portion;

said passage having a center portion between the opening at the first end and the closed portion at the second end, said center portion being disposed at a position higher than that of said closed portion at the second end and said opening at the first end;

a support extending between said insulator to said electrode through said center portion and said opening for supporting said electrode on said insulator; and heating means mounted adjacent said center portion of said passage disposed at the higher position for heating the center portion more than the closed portion with the insulator and more than said chamber.

2. An electric dust collector according to claim 1, wherein said passage comprises one of a set of passages each formed into an arch shape and a pipe for communicating between said set of passages near a top of said passages.

3. An electric dust collector according to claim 1, wherein said passage comprises one of two passages formed into an arch shape and combined in parallel.

4. An electric dust collector, comprising a dust collecting chamber having an upper end:

a discharge electrode in said chamber;

a passage at the upper end of said chamber;

duct means for forming a blind duct communicating with the passage;

an insulator in the blind duct;

elongated support means extending from the insulator through the duct and the passage to said discharge electrode for suspending said discharge electrode in said chamber;

heating means for heating the passage above the chamber;

said duct means holding said insulator in the blind duct below the heated passage;

said heating means being arranged for heating the passage above the chamber more than said chamber and more than said duct.

5. A collector as in claim 4, wherein said duct means holds said insulator sufficiently below the heated passage to maintain the insulator at a temperature below a given temperature.

6. A collector as in claim 4, wherein said passage and said blind duct form an arch shape and said passage is above said chamber.

7. A collector as in claim 4 wherein the passage, when heated, interrupts convection flow from the chamber to said duct.

8. An electric dust collector, comprising:

a dust collecting chamber having an upper portion;

a discharge electrode in said duct collecting chamber;

a passage having an opening communicating with the upper portion of said dust collecting chamber and having a closed portion;

an insulator mounted in said closed portion;

said passage having a center portion between the opening and the closed portion, said center portion being disposed at a position higher than that of said closed portion and said opening; and a support extending between said insulator to said electrode through said center portion and said opening for supporting said electrode on said insulator;

heating means mounted at said center portion of said passage disposed at the higher position for heating the center portion more than the closed portion with the insulator and more than said chamber;

said passage having an inverted V-shape extending upwardly above said chamber;

said heating means being arranged for heating the peak of said inverted V-shaped of said passage.

said heating means surrounding said peak of said passage.

* * * * *